US005931103A

United States Patent [19]

Huang

[11] Patent Number: 5,931,103

[45] Date of Patent: Aug. 3, 1999

[54] COMPUTER DESK

[76] Inventor: Huei Mien Huang, No. 23, Shr Fen Tsuen, Chi Gu Hsiang, Tainan Hsien, Taiwan

[21] Appl. No.: 08/861,130

[22] Filed: May 21, 1997

[51] Int. Cl.[6] ..... A47B 97/00; A47B 46/00

[52] U.S. Cl. ..... 108/50.02; 108/26; 108/94; 312/223.6; 248/918

[58] Field of Search ..... 108/50.02, 90, 108/25, 26, 27, 92, 180, 101, 94, 103, 139, 140, 50.01, 26.2; 312/223.3, 223.6, 223.4, 194, 195, 196, 208.1, 140.4, 231, 232; 248/918

[56] References Cited

U.S. PATENT DOCUMENTS

| | | | |
|---|---|---|---|
| 459,087 | 9/1891 | Brooks | 312/233 |
| 1,259,970 | 3/1918 | Elliott | 108/26 |
| 1,308,441 | 7/1919 | Myers | 108/50.01 X |
| 1,585,029 | 5/1926 | Guth | 312/232 X |
| 2,710,472 | 6/1955 | Leander | 108/139 X |
| 2,784,973 | 3/1957 | Nemec | 108/26 X |
| 2,935,209 | 5/1960 | Fritz | 108/25 |
| 3,255,719 | 6/1966 | Klavins | 108/26 |
| 5,154,126 | 10/1992 | Newhouse et al. | 108/50.02 |
| 5,240,210 | 8/1993 | Honto, Jr. et al. | 248/918 X |
| 5,242,223 | 9/1993 | Koves | 312/348.3 |
| 5,429,431 | 7/1995 | Olson et al. | 312/223.6 |
| 5,692,815 | 12/1997 | Murphy | 312/231 X |

FOREIGN PATENT DOCUMENTS

| | | | |
|---|---|---|---|
| 4347 | 10/1926 | Australia | 108/26 |
| 268802 | 6/1988 | European Pat. Off. | 312/223.3 |
| 2915010 | 10/1980 | Germany | 108/25 |
| 429529 | 5/1935 | United Kingdom | 108/26.2 |

*Primary Examiner*—Janet M. Wilkens

[57] ABSTRACT

A desk for supporting computer includes a top panel having a slot formed in the middle portion for engaging with a casing which is formed on a rear portion of a plate. The plate includes a front hook for engaging with the front portion of the top panel for allowing the plate to be secured to the top panel without fasteners. The casing includes one or more openings for engaging with electric wire and for allowing the electric wire to engage through the plate. A support is pivotally secured to the top panel for supporting a mouse.

7 Claims, 5 Drawing Sheets

COMPUTER DESK

BACKGROUND OF THE INVENTION

1. Field of the Invention

The present invention relates to a desk, and more particularly to a desk for supporting computer.

2. Description of the Prior Art

Typically, computers and/or monitors are directly disposed on the desks such that the desk surfaces can not be protected and may be damaged by the computers when the computers are slidably moved relative to the desk. In addition, typical computer desks have no holes for engaging with electric wires such that the electric wires are disposed everywhere on the upper and rear portion of the computer desk. In addition, no specially designed support provided for supporting the mouse.

The present invention has arisen to mitigate and/or obviate the afore-described disadvantages of the conventional computer desks.

SUMMARY OF THE INVENTION

The primary objective of the present invention is to provide a computer desk which includes a plate for supporting the computer and/or the monitor and for protecting the desk surface.

The other objective of the present invention is to provide a computer desk which includes a rotatable support for supporting the mouse. The plate includes a casing for receiving electric wires.

In accordance with one aspect of the invention, there is provided a desk for supporting computer comprising a top panel including a middle portion having a slot and including a front portion, a plate including a casing for engaging in the slot of the top panel and including a front portion, and means for securing the plate to the top panel.

The securing means includes a hook provided on the front portion of the plate for engaging with the front portion of the top panel and for allowing the plate to be secured to the top panel without fastener.

The front portion of the plate includes a curved and tapered surface for engaging with hand of a user. The casing includes at least one opening for engaging with electric wire and for allowing the electric wire to engage through the plate. The casing includes at least one partition for defining a chamber and a space in the casing. The casing includes a cover for enclosing the chamber and a cap for enclosing the space. The cap includes an orifice for engaging with electric wire.

A support is pivotally secured to the top panel.

The support includes a cavity, a post having a lower portion engaged in the cavity and having an upper portion for engaging with the top panel, and a bolt engaged through the support and the post and the top panel for securing the support to the top panel.

The top panel includes a plug for engaging with the bolt and for securing the plate to the top panel. The top panel includes a hole, the plug includes a body for engaging into the hole of the top panel and includes a peripheral flange for engaging with the plate and for securing the plate to the top panel.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
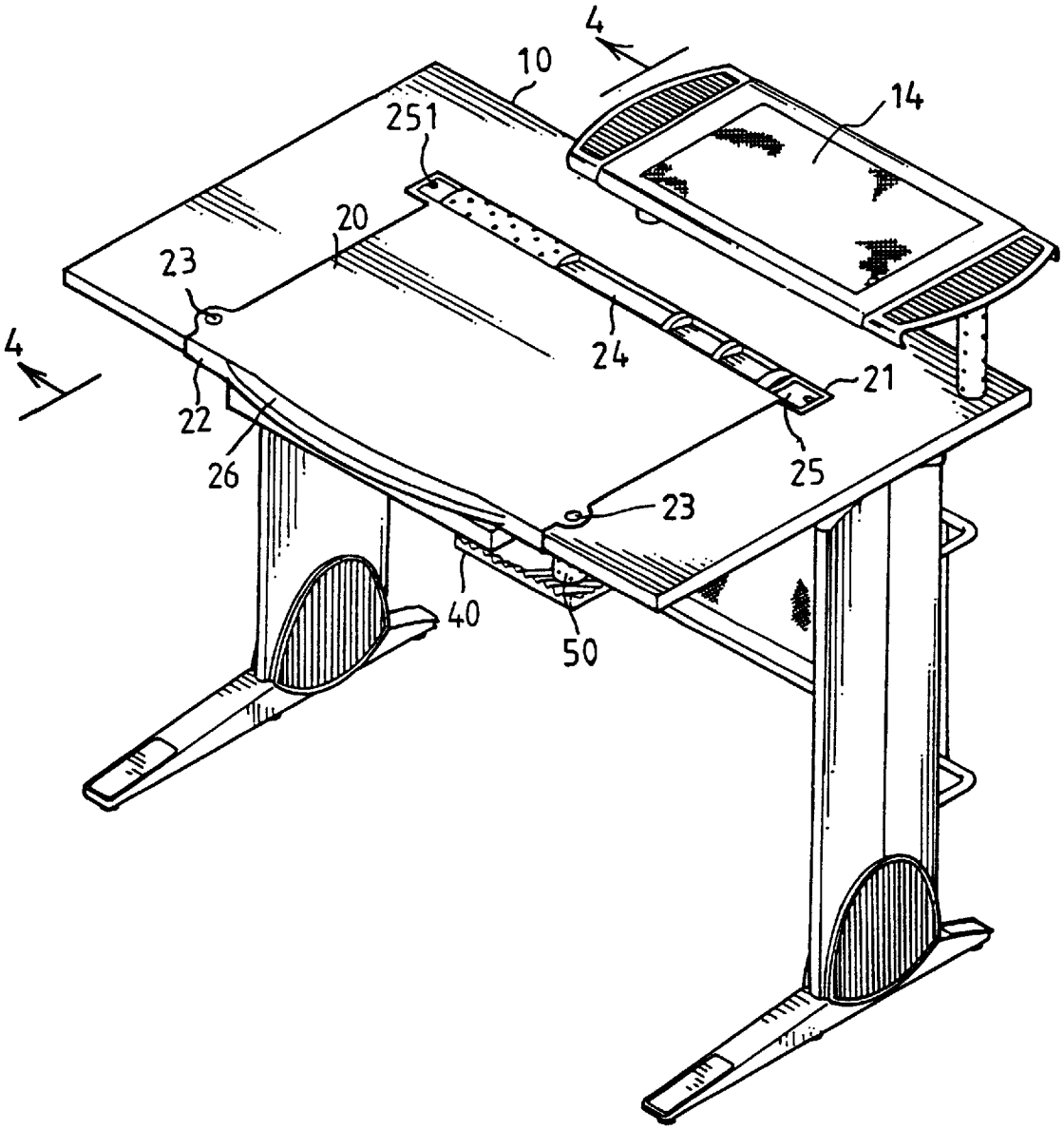
FIG. 1 is a perspective view of a computer desk in accordance with the present invention.
Figure 2:
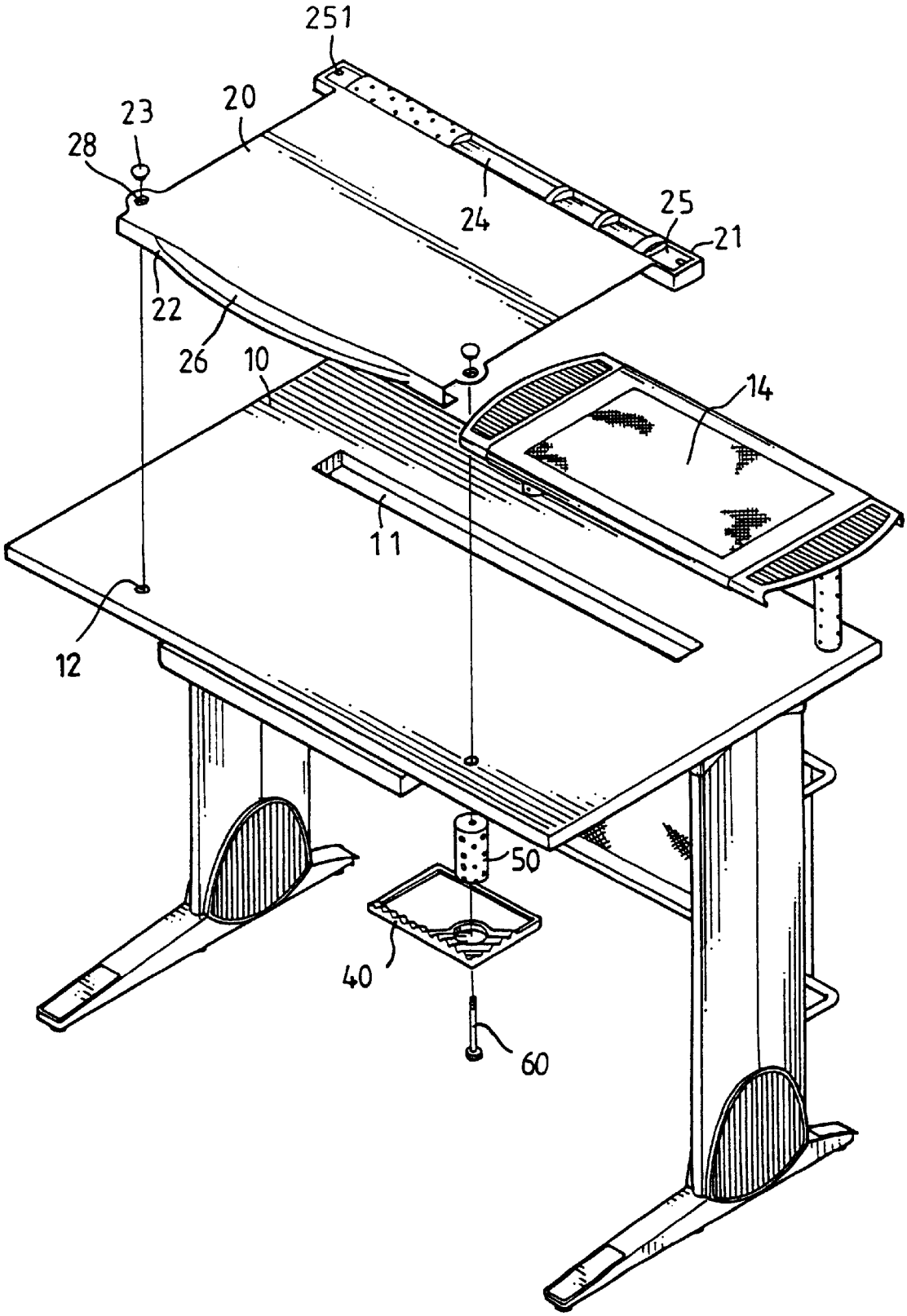
FIG. 2 is an exploded view of the computer desk.
Figure 3:
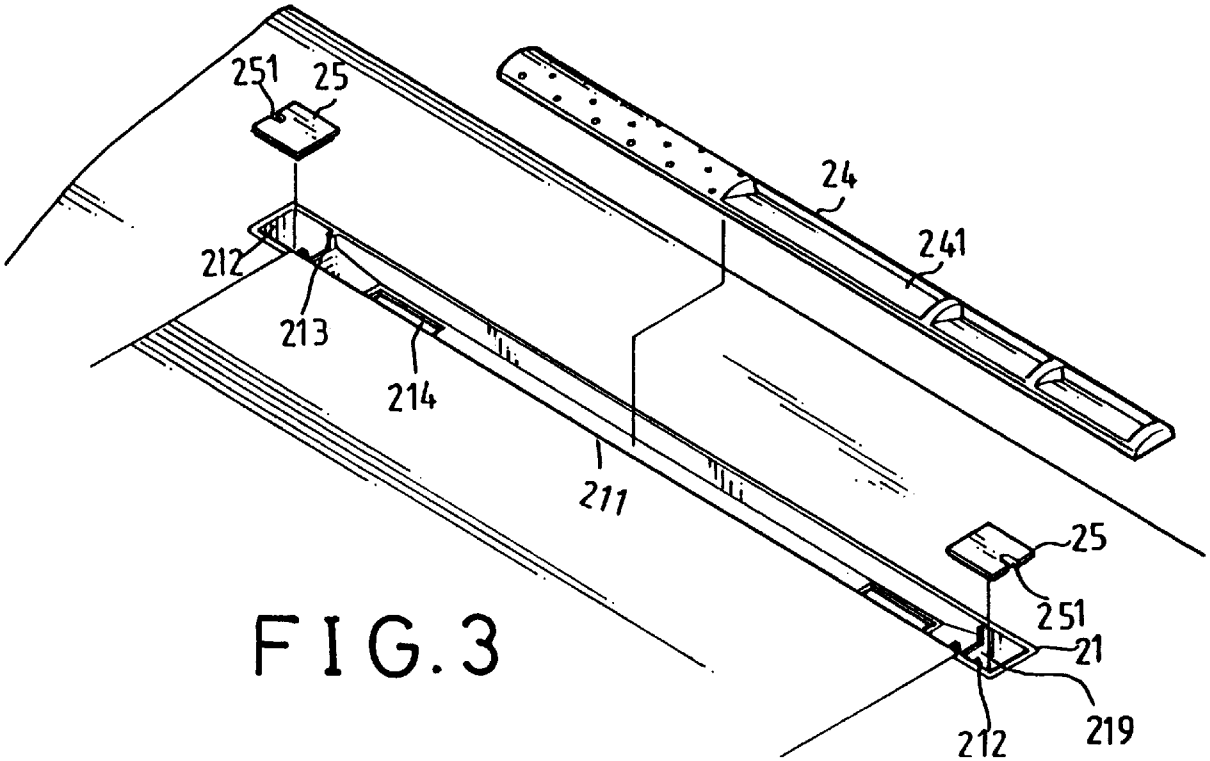
FIG. 3 is a partial exploded view of the plate.

Referring to the drawings, and initially to FIGS. 1–5, a computer desk in accordance with the present invention comprises a top panel 10 including a lateral slot 11 formed in the middle or rear portion and two holes 12 formed in the front portion and including a platform 14 for supporting such as printer or monitor. A plate 20 includes a casing 21 provided on the rear portion for engaging in the slot 11 and includes a hook 22 provided on the front portion for engaging with the front portion of the top panel 10 and for allowing the plate 20 to be secured to the top panel 10 without fasteners. The plate 20 may include a larger size and the casing 21 may be provided in the middle portion of the plate 20. The plate 20 is preferably made of resilient material, such as plastic, for allowing the hook 22 and the casing 21 to be slightly bent and to be engaged onto the top panel 10. The plate 20 includes a curved and tapered surface 26 provided on the front portion for engaging with the hand of the user and for preventing the user from engaging with the sharp corner of the top panel 10. The plate 20 includes two apertures 28 formed in the front portion for engaging with plugs 23. The plugs 23 each includes a body 231 (FIG. 6) force-fitted in the aperture 28 and each includes a peripheral flange 232 for engaging with the plate 20 and for further securing the plate 20 to the top panel 10. The plugs 23 each includes a screw hole 235 formed in the bottom portion.

Figure 5:
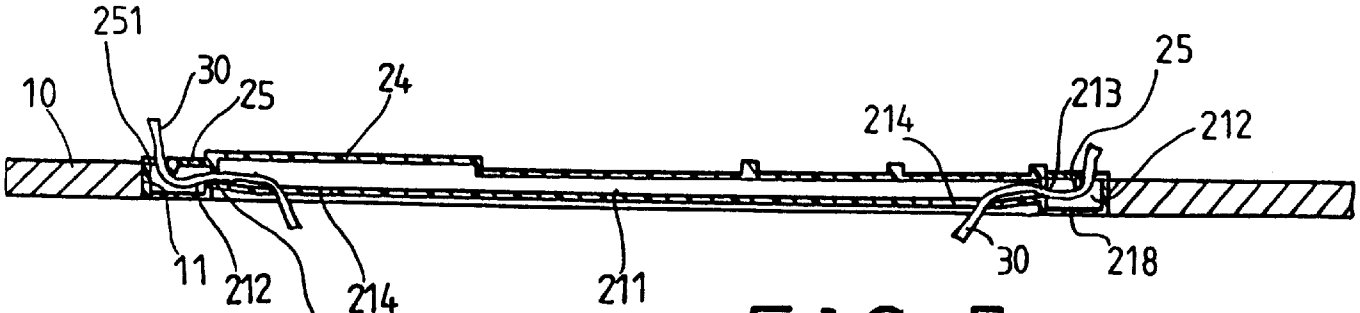
FIG. 5 is a cross sectional view taken along lines 5—5 of FIG. 4.
Figure 4:
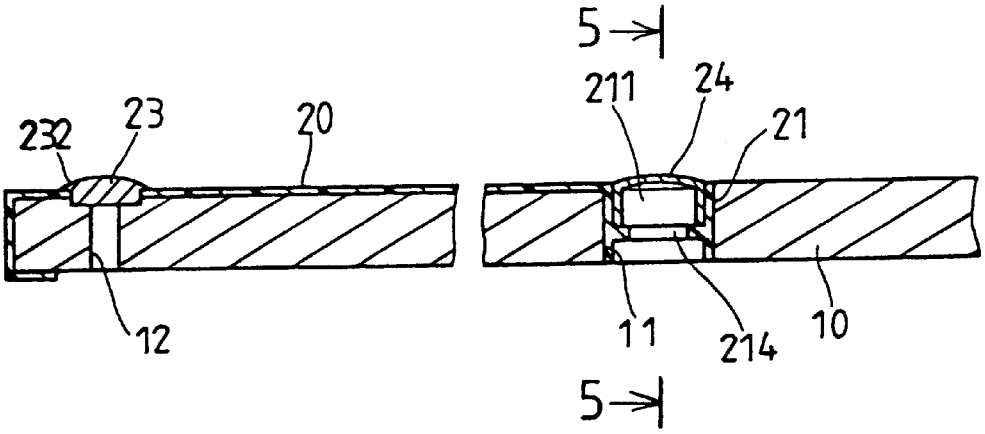
FIG. 4 is a cross sectional view taken along lines 4—4 of FIG. 1.

The casing 21 includes a chamber 211 and two spaces 212 formed in the side portions, and includes one or more openings 214, 218 formed in the bottom for allowing electric wires 30 to be engaged into the casing 21 from bottom of the top panel 10. Two partitions 219 (FIG. 3) are provided for separating the chamber 211 and the spaces 212. The partitions 219 each includes a notch 213 for allowing electric wire 30 to engage into the space 212 from the chamber 211 and for allowing the electric wire 30 to be engaged upward through the plate 20 (FIG. 5). The electric wire 30 may directly engage through the openings 218 into the spaces 212 without engaging into the chamber 211 for allowing the chamber 211 to receive pens, rubbers or other objects. A cover 24 and two caps 25 are engaged on the casing 21 for enclosing the chamber 211 and the spaces 212. The caps 25 each includes an orifice 251 for engaging with the electric wire 30. The cover 24 includes one or more depressions 241 (FIG. 3) for receiving small objects, such as clips, rubbers etc.

Figure 6:
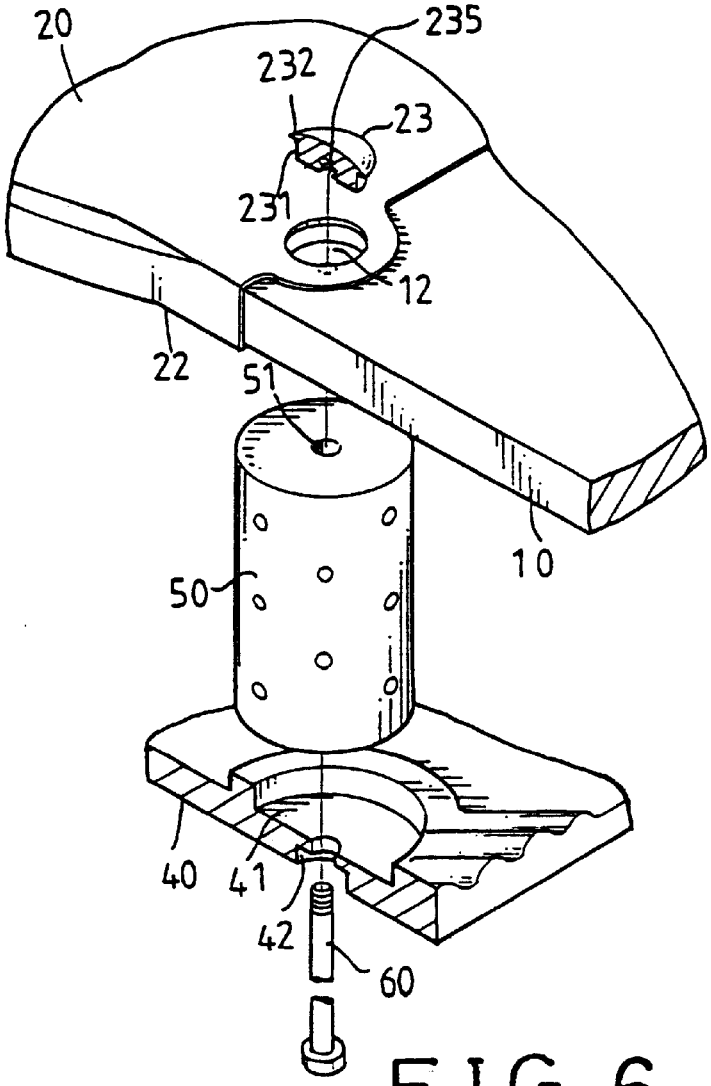
FIG. 6 is a partial exploded view of the mouse support.
Figure 7:
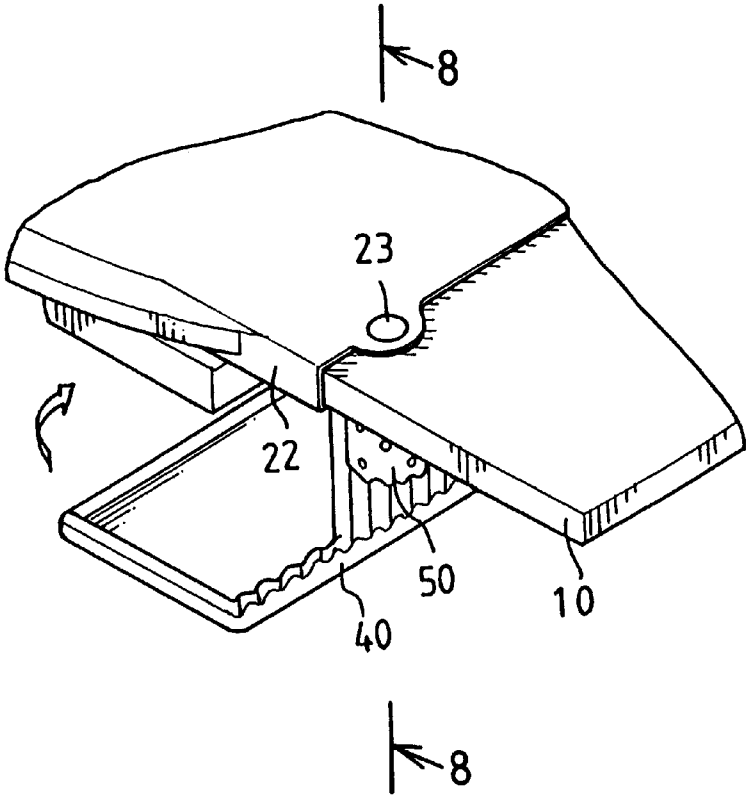
FIG. 7 is a partial perspective view of the mouse support for the computer desk.
Figure 8:
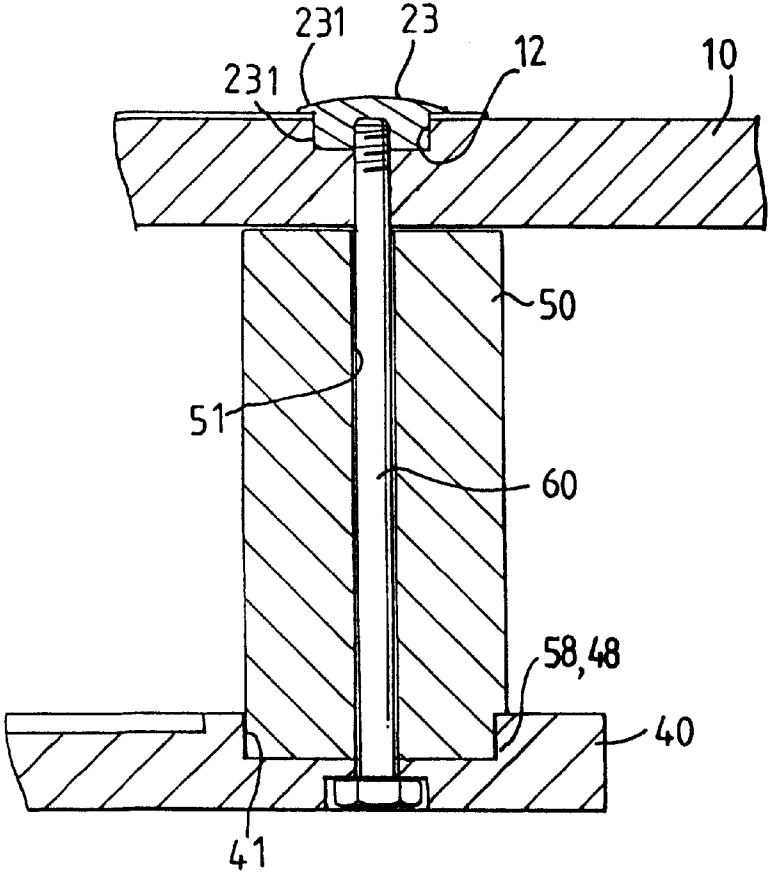
FIG. 8 is a cross sectional view taken along lines 8—8 of FIG. 7.

Referring next to FIGS. 6–8 and again to FIG. 2, a support 40 for supporting the mouse includes a cavity 41 for engaging with a bottom portion of a post 50 which includes a puncture 51 for engaging with a bolt 60. The support 40 includes an annular flange 42 for engaging with the head of the bolt 60. The bolt 60 is engaged with the screw hole 235 of the plug 23 for rotatably securing the support 40 to the top panel 10 and for allowing the support 40 to be rotated inward and outward of the computer desk. It is preferable that the support 40 includes a small projection 48 (FIG. 8) for engaging with a number of depressions 58 of the post 50 and for positioning the support 40 relative to the post 50. The support 40 may also be forced toward the top panel 10 by the bolt 60 for allowing the support 40 to be positioned relative to the top panel 10 by the bolt 60.

Accordingly, the computer desk in accordance with the present invention includes a plate secured to the top panel without fasteners, for supporting the computer and/or the monitor and for protecting the desk surface. A rotatable support may be provided for supporting the mouse. A casing includes one or more openings for receiving electric wires and for allowing the electric wires to be engaged through the top panel via the casing.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A desk for supporting computer comprising:

a top panel including a middle portion having a slot and including a front portion, a plate including a casing for engaging in said slot of said top panel and including a front portion, said casing including at least one partition for defining a chamber and a space in said casing, said casing including a cover for enclosing said chamber and a cap for enclosing said space, and means for securing said plate to said top panels said securing means including a hook provided on said front portion of said plate for engaging with said front portion of said top panel and for allowing said plate to be secured to said top panel without fastener.

2. The desk according to claim 1, wherein said casing includes at least one opening for engaging with electric wire and for allowing the electric wire to engage through said plate.

3. A desk according to claim 1, wherein said cap includes an orifice for engaging with electric wire.

4. The desk according to claim 1 further comprising a support pivotally secured to said top panel.

5. The desk according to claim 4, wherein said support includes a cavity, a post having a lower portion engaged in said cavity and having an upper portion for engaging with said top panel, and a bolt engaged through said support and said post and said top panel for securing said support to said top panel.

6. The desk according to claim 5, wherein said top panel includes a plug for engaging with said bolt and for securing said plate to said top panel.

7. The desk according to claim 6, wherein said top panel includes at least one hole, said plug includes a body for engaging into said at least one hole of said top panel and includes a peripheral flange for engaging with said plate and for securing said plate to said top panel.

* * * * *